US007568645B2

(12) United States Patent
Doppstadt

(10) Patent No.: US 7,568,645 B2
(45) Date of Patent: Aug. 4, 2009

(54) BEATER FOR A ROTARY SHREDDER

(75) Inventor: Ferdinand Doppstadt, Velbert-Langenberg (DE)

(73) Assignee: Doppstadt Familienholding GmbH, Velbert (DE)

( * ) Notice: Subject to any disclaimer, the term of this patent is extended or adjusted under 35 U.S.C. 154(b) by 0 days.

(21) Appl. No.: 11/985,853

(22) Filed: Nov. 16, 2007

(65) Prior Publication Data

US 2008/0142625 A1 Jun. 19, 2008

Related U.S. Application Data

(63) Continuation of application No. PCT/EP2006/061966, filed on May 2, 2006.

(30) Foreign Application Priority Data

May 17, 2005 (DE) ..... 10 2005 023 339

(51) Int. Cl.
*B02C 13/28* (2006.01)

(52) U.S. Cl. ..... 241/194; 241/197

(58) Field of Classification Search ..... 241/194, 241/195, 294, 197

See application file for complete search history.

(56) References Cited

U.S. PATENT DOCUMENTS

| | | | | |
|---|---|---|---|---|
| 4,871,119 | A | 10/1989 | Muruata et al. | |
| 2004/0056129 | A1* | 3/2004 | Doppstadt | 241/194 |

FOREIGN PATENT DOCUMENTS

| | | |
|---|---|---|
| DE | 2708025 | 2/1977 |
| DE | 29708025 U1 | 2/1977 |
| DE | 29 43 456 | 10/1979 |
| DE | 201 20 185 U1 | 12/2001 |
| JP | 11076851 | 3/1999 |
| WO | PCT/EP02/00100 | 7/2002 |

* cited by examiner

*Primary Examiner*—Mark Rosenbaum
(74) *Attorney, Agent, or Firm*—Lawrence G. Fridman

(57) ABSTRACT

A beater for a rotary shredder comprises an oblong base body with a pivot bearing adapted for pivotal connection of the beater to a rotor. A cutting head is formed with protruding cutting edges on opposite ends supported by the base body via the support surface. Complementary interlocking structures are provided by the support surface on the support surface and the cutting head. A releasable connection passes through the complementary structures connecting the base body with the cutting head. The complementary structures are provided by a recess formed in the support surface of the base body and a thereto complementary projection of the cutting head.

15 Claims, 4 Drawing Sheets

BEATER FOR A ROTARY SHREDDER

This is a Continuing Application of PCT application PCT/EP2006/061966 filed May 2, 2006 which claims priority of German Patent Application DE 10 2005 023 339.2 filed May 17, 2005.

FIELD OF THE INVENTION

The invention relates in general to shredding technology, and more specifically it relates to a novel design of a beater or a flail mallet adopted for use with a rotary shredder.

BACKGROUND OF THE INVENTION

Rotary shredders contain a rotating rotor. Beater or flail mallets are pivoted to this rotating rotor. The beater or flail mallets are pivotable around axes which are in parallel with the axis of rotation of the rotor. During a rotation of the rotor the beater or flail mallets are pulled outward by the centrifugal force. Then they hit material to be comminuted or shredded like a hammer while rotating. For example, such rotary shredders are used for comminuting waste wood. If a piece of material is not comminuted by a beater or flail mallet immediately, the beater or flail mallet mounted pivotable to the rotor draws back after the hit. Many beater or flail mallets provide a cutting edge trying to chop the material to be comminuted according to the manner of an axe or a hoe.

In the operation of the rotary shredder the beater or flail mallets are exposed to extensive strain and are subject to heavy wear. Generally the beater or flail mallets are wearing parts. It is known to form beater or flail mallet in two parts. A base body with considerable mass is mounted pivotable to the rotor with a pivoting bearing. A cutting head with a cutting edge striking the materials to be comminuted is attached to this base body. Nevertheless, the cutting head is subject to wear and must be replaced every so often. However, the base body does not normally need to be replaced. The cutting head, or at least the cutting edge, can be hardened. Important in doing so is to produce the attachment of the cutting head attached to the base body in such a manner able to absorb the heavy beating loads and not provide any weak points. The beating forces should be transferred from the base body (with large mass) to the cutting head and therewith to the materials to be comminuted completely. The reaction force during the impact on the materials to be comminuted should be absorbed by the base body.

Different beater or flail mallets of this manner are known.

U.S. Pat. No. 2,267,865 discloses a L-shaped mallet for a rotary shredder in which a first arm supports a pivot bearing on its end and a crushing body forms the second arm of the "L". Generally this crushing body is cubical and provides pairs of cutting edges on opposite side surfaces. The cutting edges extend in parallel with the axis of rotation of the L-shaped mallet. This block-like crushing body is screwed to the first arm of the mallet with a threaded bolt. Thereby the threaded bolt extends crosswise to the cutting edges along the plan of symmetry between the side surfaces forming the cutting edges. The cutting edges are formed by almost 90° edges of the cubical crushing body. A rectangular projection is seated on the first arm to which the cubical crushing body is attached with a corresponding rectangular passage channel. The threaded bolt is passed through a bore in the projection and the passage channel. In this arrangement the forward side surface of the cubical crushing body basically is perpendicular to the moving direction. During rotation of the rotor the crushing body hammer-like strikes the materials to be comminuted with its side surface forming the cutting edges.

The German patent document DE 29 43 456 A1 points out a two-part beater or flail mallet for rotary shredders. In this beater or flail mallet the cutting edges of the cutting head are aligned with the end faces of the base body. The attachment of the cutting head to the throughout plane surface of the base body is carried out with only one screw.

U.S. Pat. No. 5,285,974 teaches a two-part beater or flail mallet for a rotary shredder. In this beater or flail mallet a comminuting body is screwed to a base body. The base body has a block-like main part with a pivot bearing and a flat part projecting from it with substantial less thickness. A half-moon-like comminuting body with two protruding cutting edges is screwed to this flat part. The comminuting body is vibration-isolated from the base body. The cutting edges of the comminuting body are extending over the base surface of the flat part in direction of motion of the beater or flail mallet.

The published US patent application US 2004/0056129 A1 shows a two-part beater or flail mallet for a rotary shredder with a base body and a comminuting head or cutting head. The base body provides a section of larger thickness forming a pivot bearing at its end. With this pivot bearing the beater or flail mallet is pivoted to a rotor. Outwards, thus away from the pivot bearing the section of larger thickness is followed by a section of less thickness forming a basically plane and about radial to the axis of rotation extending support surface on its front side. Between the support surface and the surface of the section of larger thickness a step is provided with an inclined area. A cutting head with an approximately trapezoidal cross section is seated on the support surface. Cutting edges are provided by the acute angles of the trapezoidal cross section of the cutting head. Thereby the cutting head is seated on the support surface with its back surface corresponding to the smaller edge of the trapeze. The cutting edges are provided on the surface opposite to the support surface. The radial outer cutting edge protrudes inclined upwards and outwards beyond the end face of the base body. The other cutting edge is supported by the inclined area of the step. On the one hand the connection between the base body and the cutting head is carried out by the cutting head fitting against the support surface and the inclined area of the step as well as a threaded bolt. On the other hand a truncated pyramidal projection is provided on the support surface. The cutting head provides a truncated pyramidal recess complementary to the projection. The cutting head is attached with its recess on the projection. The threaded bolt extends through the recess and the projection. Thereby, opposite side surfaces of the pyramid are aligned with the cutting edges.

In this arrangement very strong forces and moments must be transferred from the cutting head to the base body, when the cutting edge lying far outwards beyond the base body strikes a part to be comminuted with a large impulse. In the beater or flail mallet according to US 2004/0056129 A1 the cutting head is weakened just at the point transferring substantially the forces and moments to the base body by the truncated pyramidal recess and the thereto aligned recess for the head of the bolt. This can lead to a breakage of the cutting head during continuous operation limiting the lifetime of the beater or flail mallet.

SUMMARY OF THE INVENTION

The present invention relates to a beater or flail mallet for a rotary shredder which consists of an oblong base body with a pivot bearing provided for pivotal connection of the beater or flail mallet to a rotor. The arrangement is pivotable about an axis of rotation which is parallel to the rotor axis and to a support surface extending to the free end of the base body. A cutting head is formed with protruding cutting edges on opposite ends supported by the base body via the support surface. A complementary interlocking structures are provided by the support surface on the support surface and the cutting head. A releasable connection means passes through the complementary structures connecting the base body with the cutting head.

It is the object of the present invention to provide a beater or flail mallet having an increased lifetime and ensuring an improved absorption of the forces affecting the cutting edge by the strong base body.

One of the essential features of the invention relates to a complementary structure of the beater or flail mallet formed by a recess provided in the support surface of the base body and is complementary to a projection of the cutting head.

Thus, instead of providing a recess, the cutting head contains a projection. With this a weakening of the relative thin cutting head is avoided. On the contrary the cutting head is strengthened by the projection and its additional material. The recess complementary to the projection is provided by the more massive base body. The base body is formed having mass substantially greater than the cutting head. The base body is subject to reduced wear and therefore only has to be changed sparingly, if at all. The base body should have a significant mass for increasing the effect of beating. Normally the cutting head is made of harder material. Aside from the risk of breakage the cutting head is subject to heavy wear upon the cutting edge and has to be exchanged often. Thus the cutting head should not contain an unnecessary amount of material and just ensure a proper transfer of forces to the base body.

Further embodiments of the present invention with advantageous arrangements are subject matter of the subclaims.

An example of an embodiment according to the present invention is described below in greater detail with reference to the accompanying drawings.

DETAILED DESCRIPTION OF THE INVENTION

The beater or flail mallet 10 comprises a base body 12 and a cutting head 14 connected to each other. The base body 12 has an elongated configuration. At one end the base body a bore 16 is provided for a pivot bearing. The beater or flail mallet is pivoted by means of a pivotal bearing to a rotor together with other similar beaters.

Figure 1:
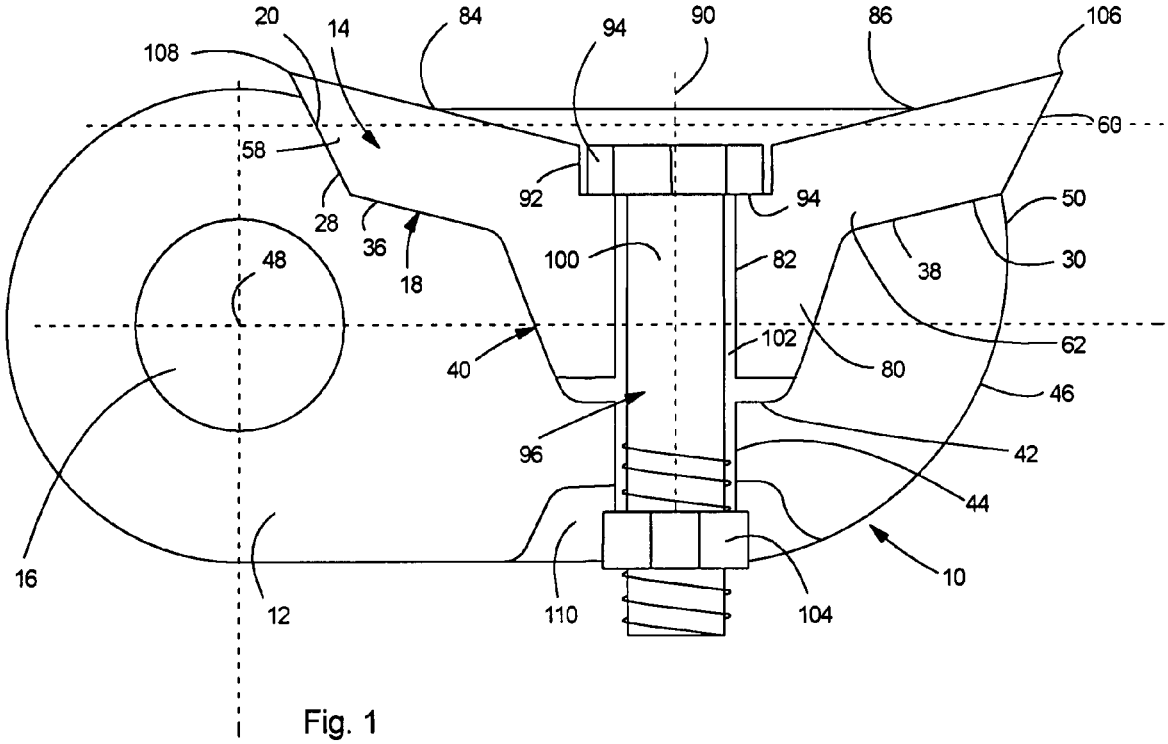
FIG. 1 shows a longitudinal section view of a beater or flail mallet for a rotary shredder.

The base body 12 provides a support surface for the cutting head 14. Generally the support surface is referred to with the reference number 18. As shown in FIG. 1, adjacent to the thickened end part of the base body 12 containing the bore 16, the support surface 18 provides a step with an inclined area 20. Adjacent to that, the support surface 18 forms a shallow four-sided truncated pyramidal recess 22. The base face of the truncated pyramid is rectangular having two longitudinal sides 24, 26 extending in longitudinal direction of the beater or flail mallet 10 along the side surfaces of the base body 12 and two lateral sides 28 and 30 extending across the complete width of the base body 12. The lateral side 28 forms the border between the inclined area 20 and the recess 22. The lateral side 30 basically forms the outer front edge of the base body 12. The shallow recess 22 provides four trapezoidal surfaces 32, 34, 36, and 38 adjacent to each other, from which the surfaces 32 and 34 extend longitudinal to the base body 12 and the surfaces 36 and 38 extend across the base body 12. Adjacent and central to this shallow recess the support surface forms a steeper and deeper recess and also four-sided pyramidal recess 40. The base face of the truncated pyramid defining the recess 40 is quadratic wherein the sides of the quadrate are aligned with the longitudinal sides of the base body 12 and lateral to them, respectively. The recess 40 has a plane bottom 42. A bore 44 is provided in the center of the bottom 42 and through the base body 12. The front end of the base body 12 forms a rounded end face 46. The end face 46 returns from a front edge 50 with respect to the axis 48 of the bore 16, this means the distance between the end face 46 and the axis 48 gets continuous smaller from the front to the back.

It is assumed in this context that the (not shown) rotor rotates counter-clockwise in FIG. 1. Thus, considering FIG. 1 as a snapshot, the beater or flail mallet moves from the bottom to the top of FIG. 1. According to this, in this context the upper surfaces in FIG. 1 are designated as front surfaces and the bottom surfaces in FIG. 1 are designated as back surfaces. "Inner" stands for on the side of the axis of rotation 48 and "outer" for on the side of the free end of the beater or flail mallet 10 or allocated to this end.

Figure 3:
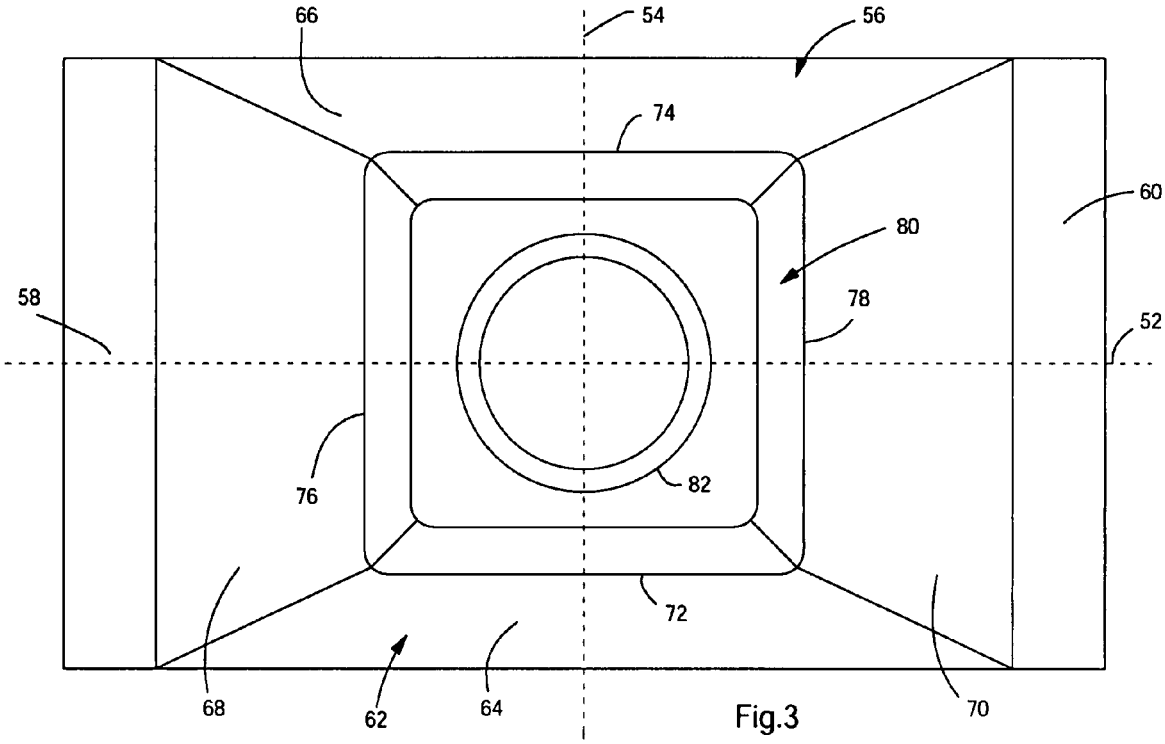
FIG. 3 shows a bottom view of the beater or flail mallet of FIG. 1.
Figure 4:
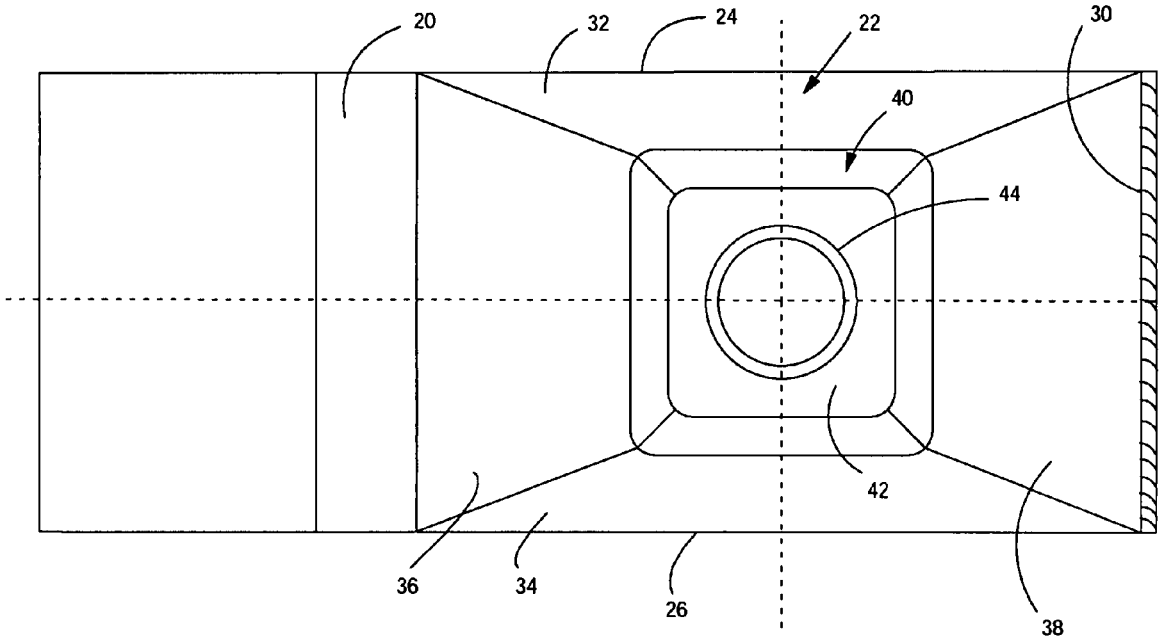
FIG. 4 shows a top view of the base body, wherein the cutting head is removed.

The cutting head 14 is mounted on the support surface 18. The cutting head 14 is formed symmetrically with respect to its longitudinal middle plane 52 as well as to a plane 54 vertical to this. Basically the back side of the cutting head 14 is complementary to the support surface 22 of the base body. This back side is shown in FIG. 3 and generally referred to with 56.

The back side 56 of the cutting head 14 has two plane inclined surfaces 58 and 60. These inclined surfaces form the inner and the outer end faces of the cutting head 14, respectively. The inclined surface 58 extends from the top left to the bottom right in FIG. 1. The inclined surface 60 extends in symmetry to this from the top right to the bottom left in FIG. 1. Adjacent to the inclined surfaces 58 and 60 the back side 56 of the cutting head forms a shallow four-sided truncated pyramidal raising 62 having two trapezoidal side surfaces 64 and 66 in the longitudinal direction of the beater or flail mallet 10 and two trapezoidal side surfaces 68 and 70 lateral to them. The side surfaces 68 and 70 join to the inclined surfaces 58 and 60, respectively. The adjacent shorter parallel sides 72, 74, 76, 78 of the trapezes join to one another and form a quadrate. This quadrate is the base face or a steeper and higher four-sided truncated pyramidal projection 80. A bore 82 extends centrally through the projection 80, which aligns with the bore 44 of the base body in a mounted state and has the same diameter like bore 44.

Figure 2:
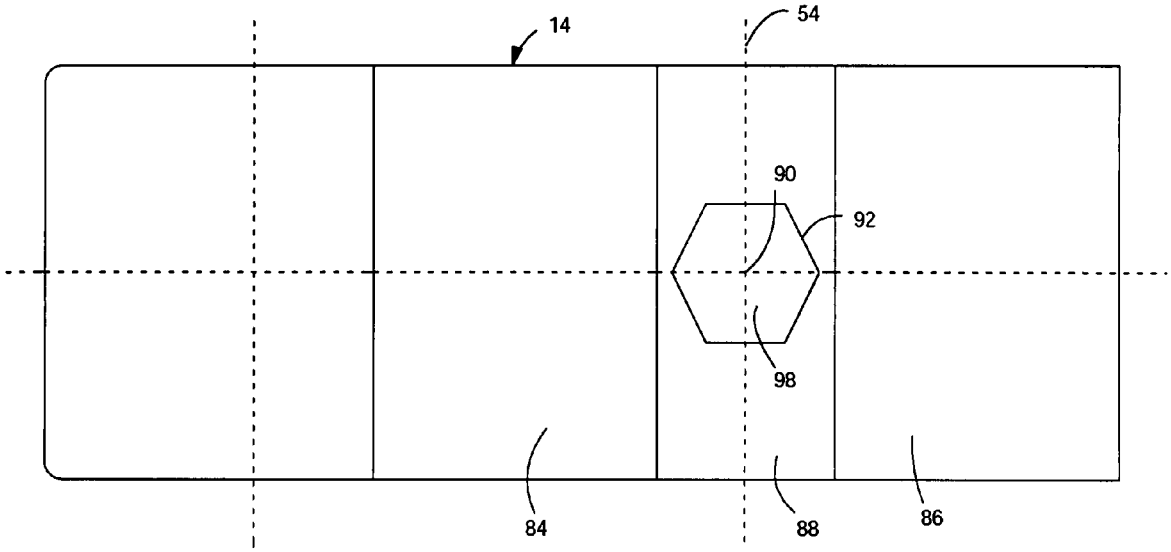
FIG. 2 shows a top view of the beater or flail mallet of FIG. 1.

The front side of the cutting head 14 (in the top of FIG. 1) can be seen in FIGS. 1 and 2. The front side of the cutting head 14 provides two rectangular near-planar or planar surfaces 84 and 86, which are symmetric to the plane 54. The sides of the surfaces 84 and 86 are aligned with the longitudinal and lateral direction of the beater or flail mallet. The planes of the plane surfaces 84 and 86 form an obtuse angle. Thus, the surfaces 84 and 86 arise forwards and away from the plane of symmetry and up to the end surfaces 58 and 60, respectively. Between the surfaces 84 and 86 a plan surface 88 is provided vertical to the axis 90 of the bores 44 and 82. Therefore the front side of the cutting head 14 forms a shallow groove limited by the surfaces 84, 88 and 86. In the mid surface 88 a hexagonal recess is provided centrally to the axis 90, which forms a shoulder 94 around the bore 82.

A threaded bolt 96 with a hexagonal head 98 extends through the bores 82 and 44. The head 98 is hold in the recess 92 and seated on the shoulder 94. The diameter of the shaft 100 is slightly smaller than the inner diameter of the bores 82 and 44. Thus, an annular gap 102 is formed between the inner walls of the bores 82 an 84 and the shaft 100. The threaded bolt 96 is tightened by a nut 104 on the back side of the beater or flail mallet 10. The nut 104 is seated in a recess 110 on the back side of the base body 12.

Then the cutting head 14 is fixed to the support surface 22 so that the end face 58 of the cutting head 14 abuts to the inclined surface 20 of the base body and is supported by it, while the opposite end face 60 extends tangential with the end face 46 of the base body 12 and all but joins it. The cutting head 14 provides a cutting edge 106 between the surface 86 and the end face 60. This cutting edge protrudes forwards and outwards beyond the base body.

The described construction operates as follows:

The comminuting of materials results primarily from the wedge effect of the protruding cutting edge. The base body is located in "the shadow" of the cutting edge and therefore is almost not subject to wear. However, the reaction forces emerging during the comminuting have to be transferred from the cutting edge to the base body. This is provided by the special shape of the base body 12 and the cutting head 14. The cutting head is guided on the base body 12 using the complete area of support in longitudinal as well as lateral direction by the shallow four-sided truncated pyramidal recess 22 of the base body 12 and the thereto complementary raising 62 on the back side of the cutting head 14. This is superior to the invention disclosed in U.S. Patent Publication US 2004/0056129 A1, where the cutting head is supported by a plane surface of the base body. Different to the aforementioned US 2004/0056129 A1 in the present invention, a form-closed support is achieved by a truncated pyramidal projection 80 on the cutting head 14 engaged in a recess 40 of the base body. Thus the cutting head is strengthened and not weakened. The threaded bolt 96 is passed through the bores 82 and 44 without engagement and therefore is stressed only by tensile load and not by shearing strain.

If a cutting edge 106 is worn out, the cutting head can be turned around 180° by loosening the threaded bolt 96 and making further use of the cutting head with the other cutting edge 108.

What is claimed is:

1. A beater for a rotary shredder, comprising:

a cutting head having front and rear portions with cutting edges protruding outwardly at the front portion; the rear portion of the cutting head is formed having an inclined surface;

a base body having a pivot bearing for pivoting to a rotor, said base body provided with front and rear sides; a support surface extending within the body between the front and rear sides and adapted to receive the rear portion of the cutting head; the support surface comprises interconnected front and rear recesses diposed within the base body along a longitudinal axis thereof;

said front recess having an inclined surface configured for engaging and holding the inclined surface of the rear portion of the cutting head; and said rear recess axially extending from the front recess is formed having a pyramidal configuration.

2. The beater according to claim 1, wherein said front recess is a truncated pyramidal recess in said support surface of said base body and said inclined surface of the cutting head forms a truncated pyramidal projection complementary to the front recess.

3. The beater according to claim 2, wherein said projection forms a regular four-sided pyramid with two opposite sides of the pyramid base surfaces extending parallel with said cutting edges of said cutting head.

4. The beater according to claim 3, wherein said inclined surface of the rear portion of said cutting head provides a shallow projection insertable into the complementary recess of said support surface.

5. The beater according to claim 2, wherein said front recess and said projection form four-sided pyramids complimentary to each other with two opposite sides of the pyramid base surfaces extending across the longitudinal direction of said base body.

6. The beater according to claim 1, wherein said front recess in said support surface of said base body is a four-sided truncated pyramid with two opposite side surfaces of the truncated pyramid extending in the longitudinal direction of said base body, and the inclined surface of the cutting head is arranged in parallel with said cutting edges.

7. The beater according to claim 1, wherein:

said cutting head further comprising an end face connecting said front and rear portions thereof and extending outwardly from the rear portion at an angle to the front portion; and releaseable connection means connecting said base body with the cutting head;

said outer cutting edge in relation to said axis of rotation of said beater protrudes radially over said base body and said inner cutting edge lies against a tilting step of said support surface.

8. The beater according to claim 7, wherein:

said front portion of said cutting head defines two plane surfaces forming an obtuse angle opening oriented forward with respect to the direction of rotation, so that said front portion has the shape of a shallow groove; and said connection means is a threaded bolt passing through said projection and through said base body so as to be tightened by a nut.

9. The beater according to claim 8, wherein said base body provides a recess in its side opposite to said head of said threaded bolt protective containing said nut.

10. The beater according to claim 8, wherein:

the outer diameter of said threaded bolt is smaller than the inner diameter of said bore; and a shank of said threaded bolt is retained in the center of said bore by said head and said recess with formation of an angular gap.

11. A beater for a rotary shredder, comprising:

a cutting head having front and rear portions with cutting edges protruding outwardly at the front portion; the rear portion of the cutting head is formed having an inclined surface;

a base body having a pivot bearing for pivoting to a rotor, said base body provided with front and rear sides, a support surface extending within the base body between the front and rear sides and adapted to receive the rear portion of the cutting head; said support surface comprises interconnected front and rear recesses diposed within the base body along a longitudinal axis thereof;

said front recess provided with a plurality of inteconnected surfaces is in the form of a truncated pyramid having a front crossection being greater than a rear crossection thereof, the interconnected surfaces of the truncated pyramid are adapted for receiving and holding the inclined surface of the rear part of the cutting head;

said rear recess axially extending from the front recess is formed having a pyramidal configuration; and releasable connection means passing through the beater, so as to provide interlocking connection between the cutting head and the base body.

12. The beater according to claim 11, wherein the plurality of interconnected surfaces of the front recess is a plurality of trapezoidal surfaces and the inclining surface of the rear portion of the cutting head engages said trapezoidal surfaces.

13. The beater according to claim 12, wherein the rear recess is formed as multiple-sided pyramid with sides thereof extending from the plurality of trapezoidal surfaces of the front recess.

14. The beater according to claim 13, wherein the front recess is formed by four adjacent trapezoidal surfaces, and the rear recess is formed as four-sided pyramid with sides thereof extending from the trapezoidal surfaces of the front recess.

15. The beater according to claim 11, wherein axial extension of the rear recess of the base body is greater than the axial extension of the front recess.

* * * * *